United States Patent [19]

Colgate, Jr.

[11] Patent Number: 4,597,814

[45] Date of Patent: Jul. 1, 1986

[54] METHOD FOR MANUFACTURING CARD WITH THREE-DIMENSIONAL LABEL INCORPORATED THEREIN

[75] Inventor: Gilbert Colgate, Jr., New York, N.Y.

[73] Assignee: U.S. Banknote Corporation, New York, N.Y.

[21] Appl. No.: 778,766

[22] Filed: Sep. 23, 1985

Related U.S. Application Data

[63] Continuation of Ser. No. 554,387, Nov. 22, 1983, abandoned.

[51] Int. Cl.[4] ..... B31F 5/04

[52] U.S. Cl. ..... 156/219; 156/277; 283/107; 283/904

[58] Field of Search ..... 156/219, 277, 313; 283/74, 75, 76, 77, 106, 107, 108, 109, 110, 111, 112, 904

[56] References Cited

U.S. PATENT DOCUMENTS 3,674,622 7/1977 Plasse ..... 283/904 X 4,101,701 7/1978 Gordon ..... 283/904 X

*Primary Examiner*—Paul A. Bell

*Attorney, Agent, or Firm*—Cushman, Darby & Cushman

[57] ABSTRACT

A method of manufacturing an identification card whereby information is printed on a sheet of plastic material. A raised pattern is formed on a different sheet of material to create a holographic image. The resultant raised pattern sheet is attached to the surface of the sheet of plastic material by pressure sensitive adhesive. The surface of the plastic material is overlaminated with a transparent layer to form a sandwich and heat and pressure is applied to fuse overlaminated layers. The pattern sheet has a high melting point so that the image is viewed as three-dimensional through an overlaminated layer.

2 Claims, 3 Drawing Figures

METHOD FOR MANUFACTURING CARD WITH THREE-DIMENSIONAL LABEL INCORPORATED THEREIN

This is a continuation of application Ser. No. 554,387, filed Nov. 22, 1983, which was abandoned upon the filing hereof.

BACKGROUND AND SUMMARY OF THE INVENTION

The invention relates to a unique card, for example, an identification or credit card, incorporating an image viewable as three-dimensional and a process of manufacturing the same.

Holograms are formed as an interference pattern between light from a coherent light source such as a laser reflected or transmitted through an object of interest and light from that same source serving as a reference beam. The pattern is recorded on a photographic plate which when illuminated by a coherent light source produces an image which is perceived as three-dimensional. While a true hologram can be viewed only in at least substantially coherent light, various techniques including multiplexing and the like can be used to create a modified interference pattern viewable in white light which retains its three-dimensional illusion.

Interference patterns of the latter type which are viewable in white light have been incorporated in credit and similar identification cards. Not only do the images provide a measure of security against counterfeiting, since production of such holograms requires considerably greater skill and knowledge than the printing technology well known to those skilled in these illegal arts, but perhaps most importantly the image provides an intrinsic advertising and promotional function. A corporate logo or symbol can be made to appear three-dimensional therefore creating an indelible image in the mind of the viewer. Typically, a small label less than one square inch is placed on one side of the card and bears a corporate logo or symbol.

Placement of the label on the card, however, has proved a difficult problem. One obvious approach is simply to attach the label after overlamination to one side of the card with a suitable adhesive. The difficulty with this approach is that the label can be removed and placed on another card even if strong adhesive is used so that the possibility of illegal use of a credit card still exists. Further, the label can be easily marred by normal use of the credit card.

However, incorporating such a label within the credit card is not simple. Typically, credit cards are formed by printing a blank of PVC with the desired information and then overlaminating on each side with a transparent layer. The sandwich thus formed is placed in an oven and heated until the overlaminating layers fuse to the blank. If a holographic label is formed of PVC material and incorporated in the sandwich, during heating the image will be lost as the raised portions of the PVC melt. Moreover, such labels for practical reasons must be quickly and efficiently positioned on the credit card blanks and mounted in place.

The present invention relates to a unique card and method of manufacturing the same in which the image viewable as three-dimensional is formed as a raised pattern on a sheet of material which is different from PVC. Heat sensitive adhesive is coated on each side of the label and each of the labels then applied to an individual PVC blank. Overlaminate transparent plastic layers are then conventionally fused to the blank. The label having a higher point of melting than PVC retains its raised pattern and image. The heat sensitive adhesive is triggered by the heat to form cross-molecular bonding between the PVC and the label. Preferably, a pressure sensitive adhesive taking up less than half the surface area of the label is provided on one side thereof to hold the label in position during overlaminating. The pressure adhesive material cannot take up the entirety of one side of the label since then no bonding could take place between that side of the label and the adjacent portion of the PVC blank.

Other objects and purposes of the invention will be clear from the following detailed description of the drawings.

Figure 1:
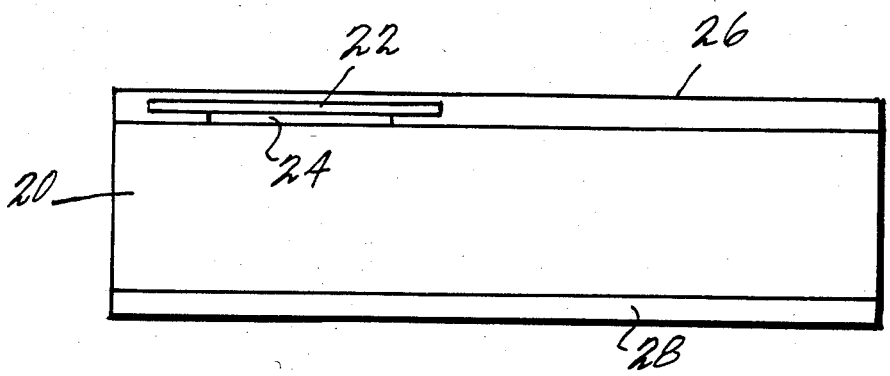
FIG. 1 shows a sectional view (not to scale) of a credit card according to the present invention.
Figure 2:
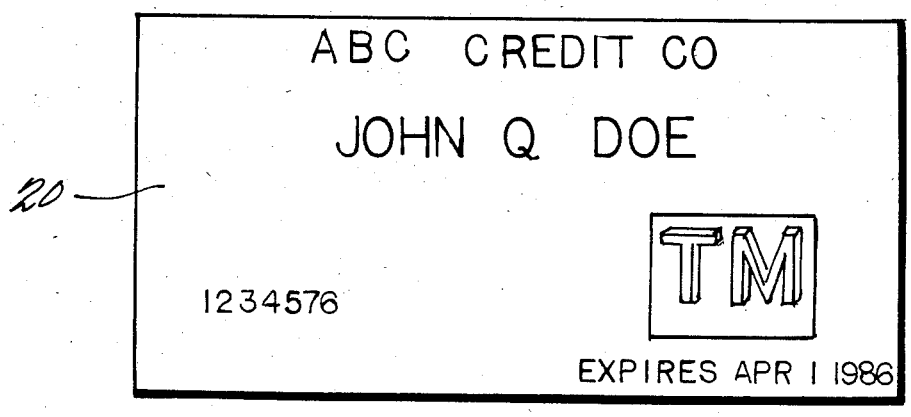
FIG. 2 shows a top view of the credit card according to the present invention.

Reference is now made to FIGS. 1 and 2 which show a credit card according to the present invention. A conventional blank 20 of PVC has printed upon it various information as can be seen in FIG. 2. A label 22 is incorporated in the credit card and defines a three-dimensional image, for example, of a corporate logo, trademark, corporate symbol or the like. The three-dimensional image is formed as a raised pattern of ink or by embossing a metallized polyester strip or the like with a holographic image formed generally as described above. Both sides of label 24 are coated with heat sensitive adhesive. Then, pressure sensitive adhesive 24, for example, in a diamond-shaped or other suitable pattern, is provided between the label 22 and the upper surface of blank 20 and serves to stick label 22 onto blank 20 during overlaminating in which thin transparent layers 26 and 28 of PVC are placed on the opposite surfaces of blank 20 and fused by heating and pressure. The heat also triggers the heat sensitive adhesive.

Figure 3:
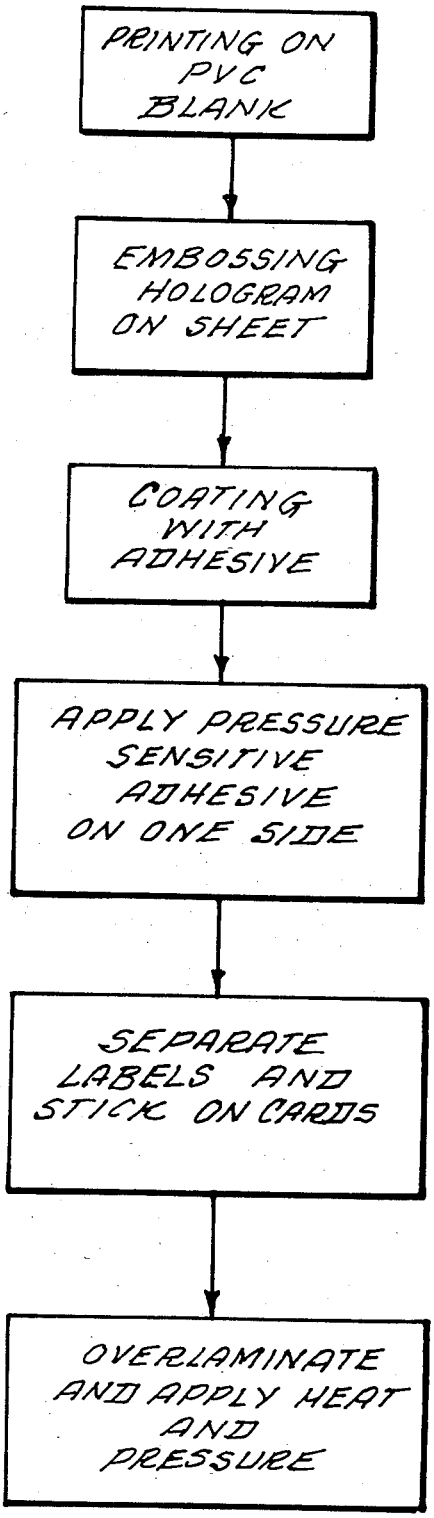
FIG. 3 shows a flow diagram of the process of the present invention.

Reference is now made to FIG. 3 which illustrates in block diagram the process of the present invention. First, information such as shown in FIG. 2 is printed on a PVC blank 20. The holograms are then formed side by side on a sheet, for example, a tape of polyester metallized on one side as a raised pattern. Any suitable technique for forming the raised pattern, for example, embossing from a nickel steel embossing plate created by electroforming of a hologram image, can be employed. Next, both sides of the embossed hologram are coated with a suitable heat sensitive adhesive, such as the adhesive known as 44-H from Synthetic Surfaces, Inc. Any suitable heat sensitive adhesive, however, can be employed.

After coating with the heat sensitive adhesive, a number of pressure sensitive adhesive portions are applied to the strip, for example, by marrying the tape to a slip sheet having areas of pressure sensitive adhesive formed thereon in a given pattern. The side-by-side labels are then separated in a suitable label machine, die cut into individual labels and the ladder conventionally removed. Subsequently, in the card manufacturing process, the slip sheet backing is removed and the labels applied to a moving roller at an area corresponding to their desired location on the credit card blanks. Labels are then placed atop the credit card blanks to which they adhere by virtue of the pressure sensitive adhesive. Overlaminating is then conventionally carried out and heat and pressure applied to fuse the overlying transparent plastic layers to the blank and to trigger the heat sensitive adhesive which forms molecular bonds between the PVC blank and the label.

The following is a detailed example of the present invention.

EXAMPLE

A sheet of PVC 23 inches×28 inches is lithographically and conventionally printed with information. A roll of polyester material six inches wide with a metallized Mylar layer on one side is embossed to create six side-by-side labels each formed as a raised pattern defining an image viewable as three-dimensional. Embossing is done with a nickel steel embossing plate created by electroforming of a hologram image and the image embossed into the metallized side of a polyester's tape. Normally, as purchased the polyester has already been treated conventionally so as to receive ink, adhesive or the like. The roll is coated on both sides with an adhesive preparation known as 44-H from Synthetic Surfaces, Inc. Such adhesives are heat triggered and, when so triggered, promote the cross-molecular bonding of the polyester and PVC. The roll is then married to a slip sheet having areas of pressure sensitive adhesive in a diamond shaped pattern which each stick to one side of a label. A side winder labeling machine from Label-aire Inc. of Fullerton, Calif., separates the side-by-side labels and transports them to the appropriate positions on a moving roller. The labels have been die cut into individual labels, the ladder has been conventionally removed and the resulting roll of labels placed in the labeling machine under which the blanks will be deposited. The slip sheet backing is removed. Each label head of the labeling machine picks up three labels and transports them to rollers which spring apart and divert the labels to a 3½ inch separation. At a cycle of 65–80 strokes/minute, in excess of 17,000 labels an hour are laid down on the PVC sheet. Ovelaminate transparent layers of PVC are conventionally applied to form a sandwich between stainless steel plates which sandwich is placed in a laminating oven at a temperature of 240°–280° F. for 7–8 minutes. The overlaminate layers fuse to the blank and the heat sensitive adhesive is triggered to promote cross-molecular bonding between the polyester and the PVC. The blank is 26 mil in thickness, the overlaminate layers each 2 mil, the heat sensitive adhesive ¼ mil and the pressure sensitive adhesive about ½ mil.

Many changes and modifications in the above-described embodiment can, of course, be carried out without departing from the scope thereof. Accordingly, that scope is intended to be limited only by the scope of the appended claims.

What is claimed is:

1. A method of manufacturing an identification card incorporating an image viewable as three-dimensional comprising the steps of:

printing information on a sheet of plastic material;

forming a raised pattern on a sheet of material different from said plastic material to create a holographic image viewable as three-dimensional;

coating said raised pattern sheet with an adhesive which promotes bonding to said plastic material;

attaching a pressure sensitive adhesive to one side of the coated and raised pattern sheet, the pressure sensitive adhesive extending over less than half the surface of said one side;

placing said coated and raised pattern sheet on one surface of said sheet of plastic material so that said pattern sheet is attached to said sheet of plastic material by said pressure sensitive adhesive;

overlaminating such surface of said plastic material with a transparent plastic layer to form a sandwich; and applying heat and pressure to said sandwich to fuse said overlaminating layers to said sheet of plastic material, said coated and raised pattern sheet having sufficiently higher melting point so that the image remains and is viewable as three-dimensional through an overlaminated layer and so that said coated and raised portion is bonded on said one side to said plastic sheet.

2. A method as in claim 1 wherein said step of forming includes the step of embossing said raised pattern of a tape of polyester metalized on one side thereof.

* * * * *